US006595493B2

(12) United States Patent
Krebs et al.

(10) Patent No.: US 6,595,493 B2
(45) Date of Patent: Jul. 22, 2003

(54) DEVICE FOR CONTROLLING A MOTOR-DRIVEN HOIST

(75) Inventors: Wolfgang Krebs, Wetter (DE); Anton Münzebrock, Dortmund (DE)

(73) Assignee: Demag Cranes & Components GmbH, Wetter (DE)

( * ) Notice: Subject to any disclaimer, the term of this patent is extended or adjusted under 35 U.S.C. 154(b) by 60 days.

(21) Appl. No.: 09/804,527

(22) Filed: Mar. 12, 2001

(65) Prior Publication Data

US 2001/0020698 A1 Sep. 13, 2001

(30) Foreign Application Priority Data

Mar. 13, 2000 (DE) ..... 100 13 231

(51) Int. Cl.[7] ..... B66D 1/00
(52) U.S. Cl. ..... 254/266; 254/275
(58) Field of Search ..... 254/266, 267, 254/329, 361, 375

(56) References Cited

U.S. PATENT DOCUMENTS 5,327,592 A * 7/1994 Stump ..... 254/362
5,772,184 A * 6/1998 Zaguroli, Jr. ..... 251/294
5,865,426 A * 2/1999 Kazerooni ..... 212/285
6,299,139 B1 * 10/2001 Kazerooni ..... 212/285
6,386,513 B1 * 5/2002 Kazerooni ..... 212/285

FOREIGN PATENT DOCUMENTS

DE 42 29 674 C2 3/1994
DE 44 12 557 C2 10/1995

* cited by examiner

*Primary Examiner*—Emmanuel Marcelo
(74) *Attorney, Agent, or Firm*—Henry M. Feiereisen

(57) ABSTRACT

A device for controlling a motor-driven hoist, includes a housing and a control unit supplied with electric energy from a power source and secured to the housing. The control unit has control elements operable from outside the housing between an inactive ready position and an active position for delivering control signals. A transmitter is supplied with electric energy from the power source and receives the control signals from the control unit for wireless transmission of the control signals to a receiver, which is operatively connected to a power controller of the drive of a motor-driven hoist. An activation switch is so operatively connected to the power source that actuation of a control element initiates a supply of electric energy from the power source, whereas the supply of electric energy from the power source is cut, when the control elements occupy their ready position.

19 Claims, 4 Drawing Sheets

DEVICE FOR CONTROLLING A MOTOR-DRIVEN HOIST

CROSS-REFERENCES TO RELATED APPLICATIONS

This application claims the priority of German Patent Application Serial No. 100 13 231.6, filed Mar. 13, 2000.

BACKGROUND OF THE INVENTION

The present invention relates to a device for controlling a motor-driven hoist for raising and lowering a load.

German Pat. No. DE 42 29 674 C2 discloses a motor-driven hoist having a load-carrying member which can be raised and lowered and is located at the lower end of a traction member. An operator grabs a handle formed at the load-carrying member to maneuver the load. The handle includes two push-button keys respectively provided to execute the functions "raising" and "lowering", and actuated by means of swivel buttons via a switching rocker in the form of a two-armed lever. The push-button keys belong to control elements that are actuated from outside. In an inactive ready position, the control elements are deactivated and refrain from transmitting electric control signals. Actuation of one control element generates electric control signals which are transmitted via a respective connection cable to the power controllers of the drive.

In order to be able to compensate the change in length of the traction member, the connection cable is configured as a helix which is guided around the traction member in a helical manner. The helix extends or contracts in response to a change in height of the load-carrying member. The available lift travel is thus restricted to the design of the helix. A further deficiency of this conventional construction is the additional space needed for the connection cable and the risk of damage of the connection cable by the traction member.

German Pat. No. DE 44 12 557 C2 discloses a configuration of a push-button key with sequentially arranged secondary contacts. Control signals for power controllers are generated by permanent magnets, disposed at the stem of the push-button key and interacting with a confronting stationary Hall sensor.

It would be desirable and advantageous to provide an improved device for controlling a motor-driven hoist to obviate prior art shortcomings.

SUMMARY OF THE INVENTION

The present invention provides for a device for controlling a motor-driven hoist, which device includes a housing, a power source, secured to the housing, for providing electric energy, a control unit supplied with electric energy from the power source and secured to the housing, with the control unit having control elements operable from outside the housing between an inactive ready position and an active position for delivering control signals, a transmitter supplied with electric energy from the power source and receiving the control signals from the control unit for wireless transmission of the control signals to a receiver operatively connected to a power controller of a drive of the motor-driven hoist, and an activation switch so operatively connected to the power source that actuation of any one of the control elements establishes a supply of electric energy from the power source, whereas the supply of electric energy from the power source is cut, when all the control elements occupy their ready position.

Through the provision of a wireless transmission of instructions by using a transmitter for sending out control signals to a receiver that is positioned at a location distant to the housing and operatively controlled to the power controller, and by integrating for the control elements and the transmitter a power supply which is controlled by the activation switch such that supply of electric energy is established when at least one of the control elements is actuated and cut when all the control elements are inactive, the need for a connection cable is eliminated so that the height of the load-carrying member can be varied unrestrictedly. Damage of such a connection cable is thus no longer an issue. The use of the activation switch ensures a long service life of the power source, as the power supply is ON only as long as one of the control elements is actuated. After actuation, the power supply is cut again. As a result, the power supply is thus separated from the control elements and the transmitter so long as the control elements are in the inactive ready position. The receiver may be supplied with electric energy from the power controllers via a common cable connection.

In a simple embodiment, each of the control elements is capable to energize/de-energize the activation switch during course of its actuation. An embodiment with a single activation switch, operatively connected to all the control elements, is simple in structure. However, it is also possible to provide a plurality of activation switches which are operatively connected to a corresponding one of the control elements, whereby the activation switches and the control elements are placed into one-to-one correspondence. Suitably, each of the control elements is configured as a push-button key so biased by a spring as to seek the ready position.

The embodiment with several control elements and a single activation switch can be implemented in a simple manner by providing a common mechanical connecting member which is placed between the control elements and the activation switch and actuated by any one of the control elements for operating the activation switch.

According to another feature of the present invention, which is ergonomically favorable, an actuating mechanism may be provided for operating two of the control elements, with the actuating mechanism including a rocker in the form of a lever having two lever arms, with one lever arm intended for operation of one of the control elements, e.g. raising of load, and with the other lever arm intended for operation of the other one of the control elements, e.g. lowering of load, and with the actuating mechanism further including a pair of push buttons operatively connected to the rocker for actuating one or the other one of the control elements.

Easy maneuvering of the load can be realized by forming the housing as a handle mounted to the load-carrying member of the hoist.

According to another feature of the present invention, the control signals may be encoded before transmission by the transmitter to prevent interferences. Suitably, the transmitter sends the control signal by means of infrared light, whereby the transmitter and the receiver confront one another and/or the transmitter sends out the instruction at a sufficiently great angle of radiation to ensure a reception by the receiver.

A plurality of drives of one or more hoists can be controlled reliably with the control device according to the present invention, when the control signal contains an address information for the receiver being addressed.

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
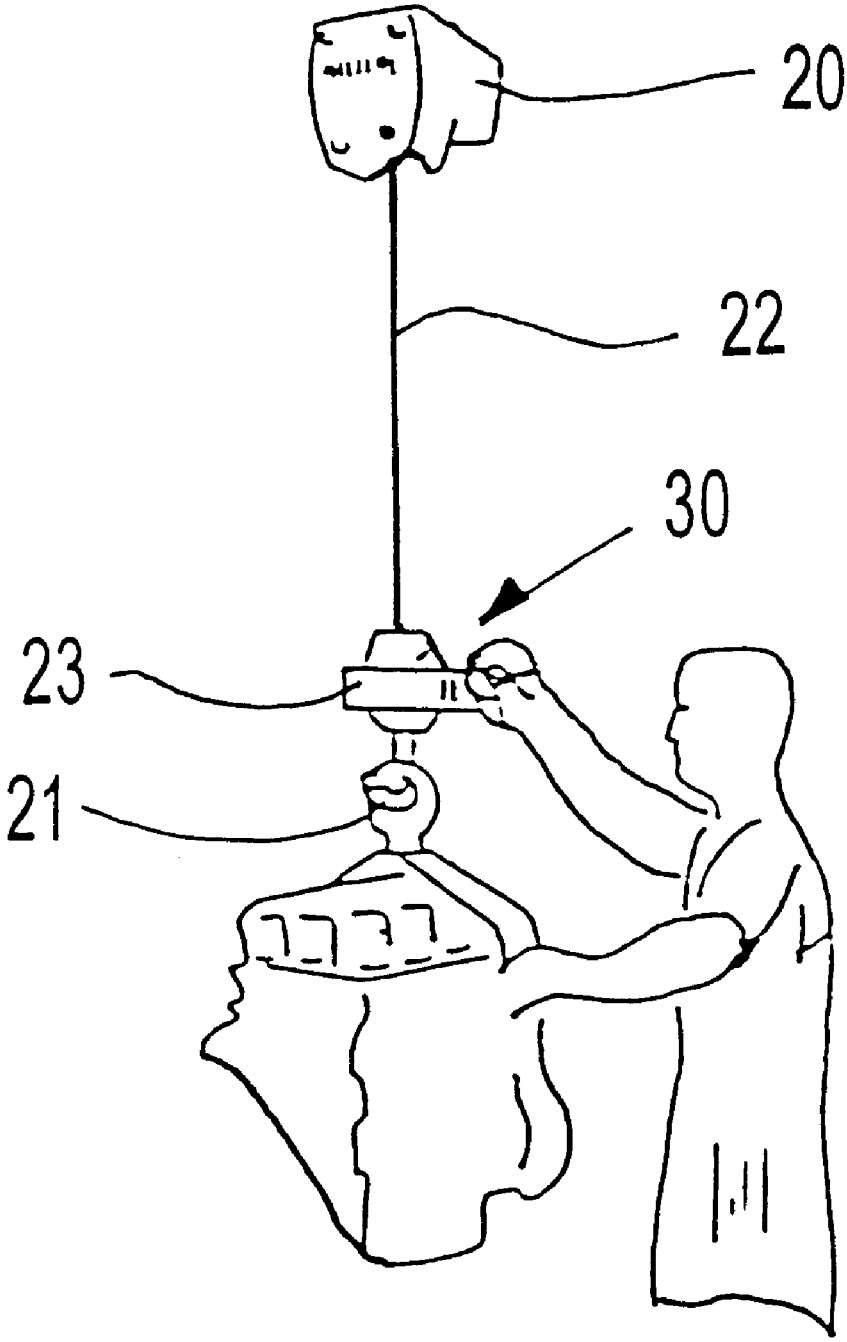
FIG. 1 is a schematic illustration of a hoist, having integrated therein a control device in accordance with the present invention.

Throughout all the Figures, same or corresponding elements are generally indicated by same reference numerals.

Turning now to the drawing, and in particular to FIG. 1, there is shown a schematic illustration of a hoist having a lifting device 20 which is mounted to any suitable carrier, e.g. a rail for movement in a horizontal direction, and provided for raising and lowering a load-carrying member 21, configured in the form of a load hook, via a traction member 22, such as a rope or chain. A control device in accordance with the present invention is generally designated by reference numeral 30 and arranged between the load-carrying member 21 and the end of the traction member 22. The control device 30 has a housing 23 configured in the form of a handle securely attached to the load-carrying member 21 and grabbed by an operator for easy maneuvering of a load. The lifting device 21 is operated by an electric motor 24 (FIG. 4) which is controllable via power controllers which are connected by respective cables to a power supply for the motor.

Figure 2:
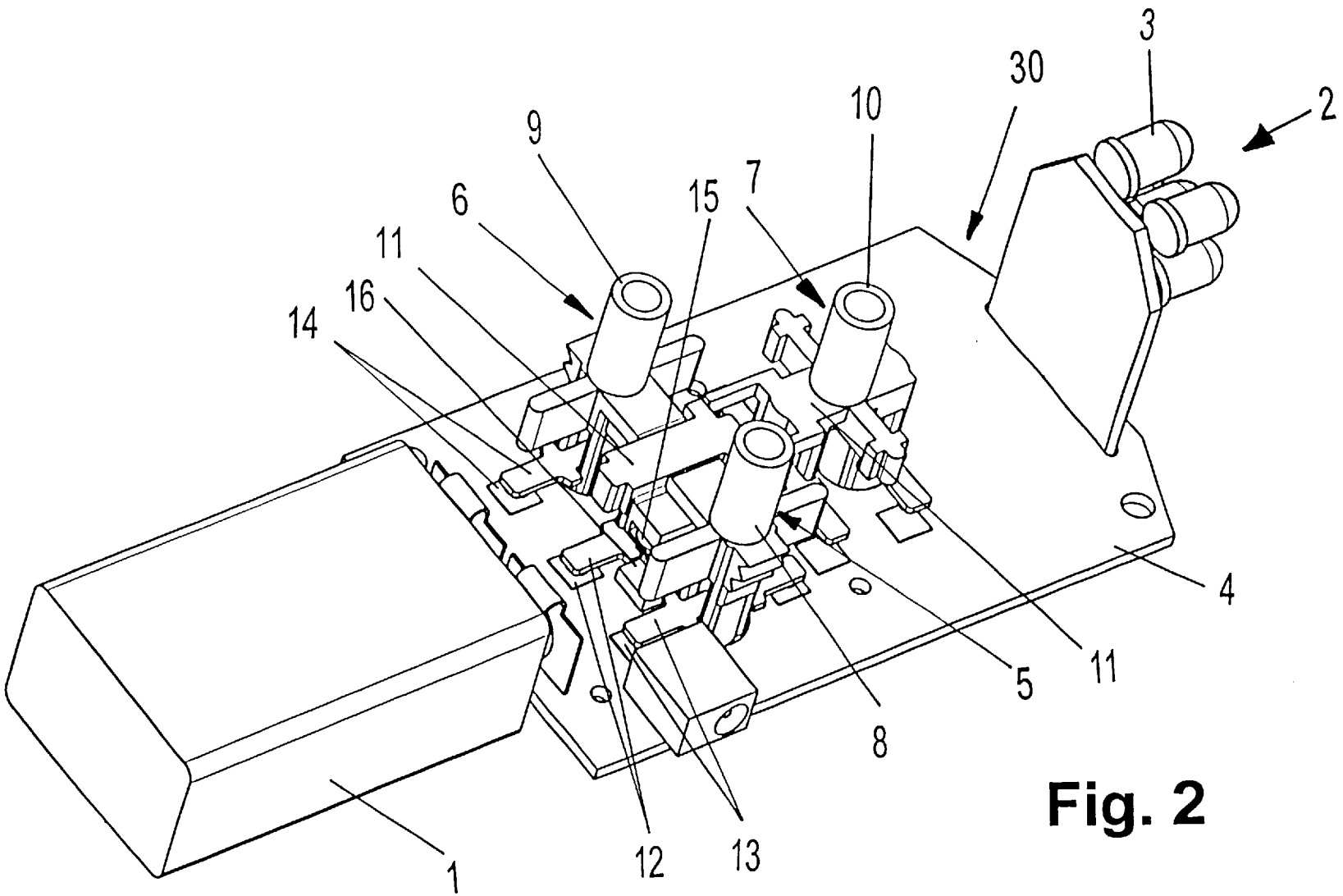
FIG. 2 is a top, front and side perspective illustration of the control device for the hoist.
Figure 3:
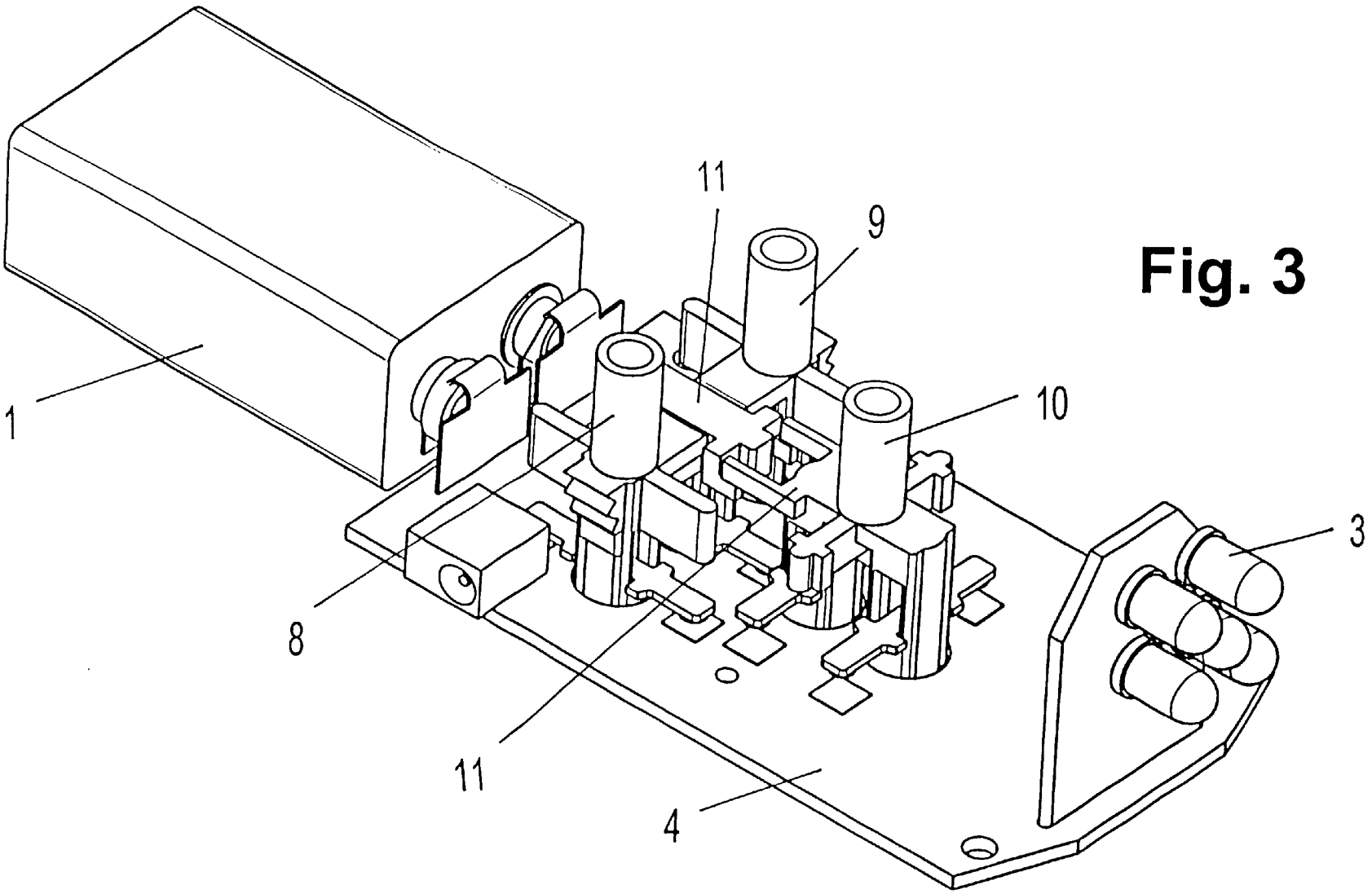
FIG. 3 is a top, rear and side perspective illustration of the control device.
Figure 4:
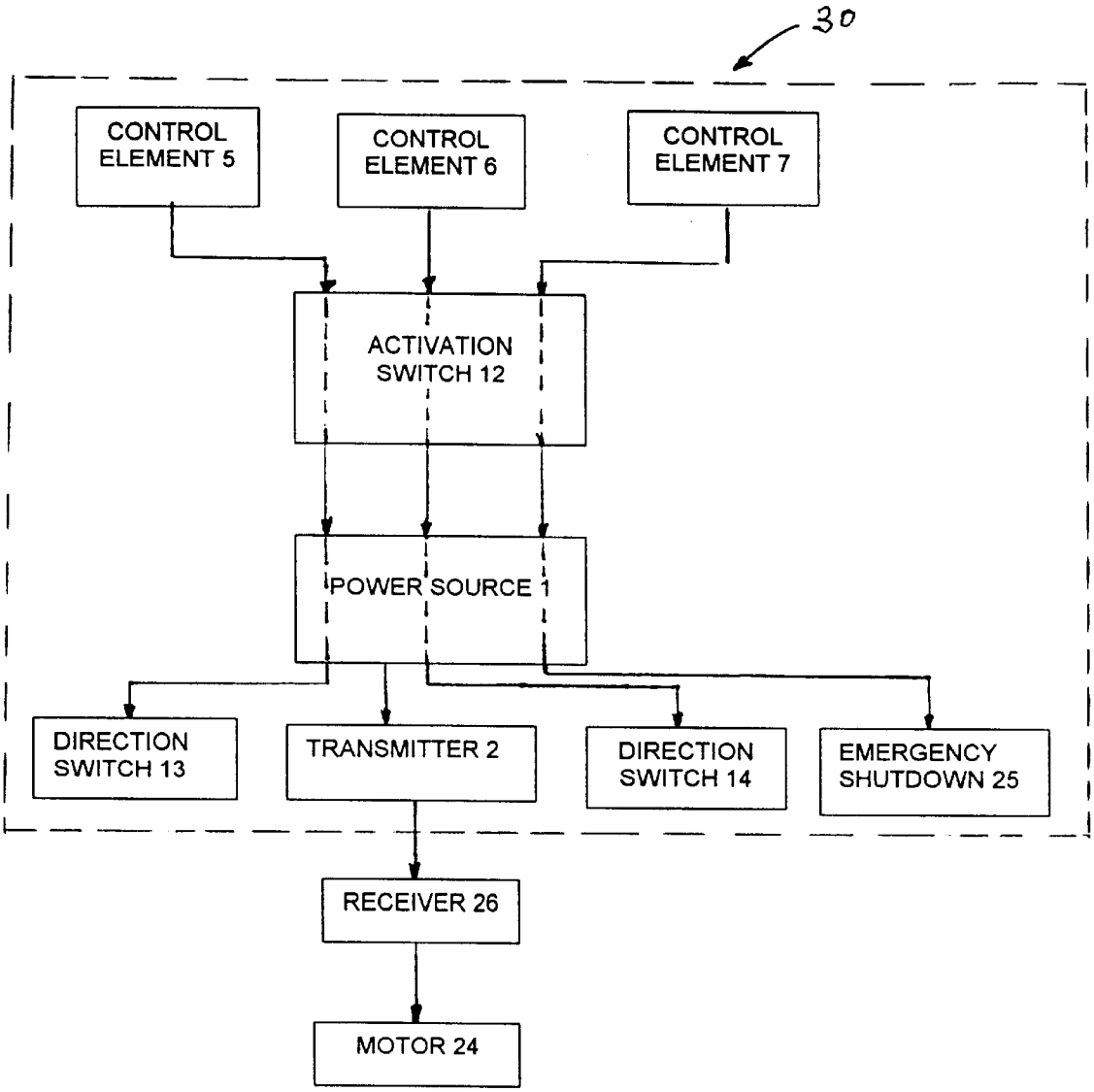
FIG. 4 is a block diagram showing the relationship and operation of the components of the control device.

FIGS. 2 and 3 shows perspective illustrations of the control device 30 for the hoist, with the housing 23 being removed to allow illustration of internal components. The control device 30 includes a power source in the form of an accumulator 1 for supply of electric power. Persons skilled in the art will understand that the accumulator 1 is shown by way of example only, and may be substituted by any other suitable power source, such as a battery or a combination of an accumulator 1 and a battery. The accumulator 1 is connected at one side of a circuit board 4. At the other side of the circuit board 4 is a transmitter, generally designated by reference numeral 2 and including infrared diodes 3. Mounted on the circuit board 4 between the accumulator 1 and the transmitter 2 are three push-button keys 5, 6, 7 operating as control elements. Each of the keys 5, 6, 7 has a, not shown, stem supported for movement in a longitudinal direction so that each key 5, 6, 7 can be shifted in longitudinal direction of the stem. The key 5 is provided to initiate the function "raising" and the key 6 is provided to initiate the function "lowering", whereas the key 7 is used for shutting down the electric motor in case of emergency via actuation of an emergency switch 25 (FIG. 4).

It will be appreciated by persons skilled in the art that the keys 5, 6, 7 must contain much electronic components which are not described or shown in the drawing for sake of simplicity, as they do not form part of the invention.

The keys 5, 6, 7 are provided at their upper end with a cylinder head 8, 9, 10 which extends in longitudinal direction of the stem and projects out of the housing 23 through suitable openings (not shown) to the outside to allow actuation of the keys 5, 6, 7 by the operator. The keys 5, 6, 7 are operatively connected to a single activation switch 12 by which the electric connection between the accumulator 1, on the one hand, and the keys 5, 6, 7 and the transmitter 2, on the other hand, can be established or cut.

In FIG. 1, the keys 5, 6, 7 are shown in their inactive ready position and urged automatically into this position by, not shown, springs. When all three keys 5, 6, 7 occupy their ready position, i.e. in their uppermost position, the activation switch 12 is in OFF position, so that the power supply from the accumulator 1 is cut. Thus, no electric energy is consumed. Only, actuation of at least one of the keys 5, 6, 7 triggers the activation switch 12 and thus establishes the power supply to electrically connect the accumulator 1 with the keys 5, 6, 7 and the transmitter 2. Each of the keys 5, 6, 7, when actuated, pushes hereby a common connecting element 11 of generally plate-shaped configuration downwards for actuation of the activation switch 12, either immediately or after traveling a given distance. The provision of the connecting element 11 ensures that each key 5, 6, 7 is capable during its displacement to activate the switch 12 and to establish the power supply.

Mounted on the circuit board 4 are further switches 13, 14 which deliver the direction signal for the power controllers and are operatively connected to the keys 5, 6. The switches 13, 14 are operative only in response to an activation of the switch 12. The keys 5, 6, 7 and the switches 12, 13, 14 are so interrelated, that actuation of either one of the keys 5, 6, 7 activates first during the course of its travel path the switch 12 and subsequently the switches 13 or 14, whereby only actuation of the keys 5 or 6 will trigger the switches 13 or 14, depending on whether the load should be "raised" or "lowered".

The connecting element 11 is provided with a permanent magnet 15 which is movable in a straight line along the connecting element 11. The permanent magnet 15 cooperates with a Hall sensor 16 which registers a change of the magnetic field during movement of the permanent magnet 15 in relation to the Hall sensor 16 and thus generates a control signal commensurate with a distance of the permanent magnet 15 from the Hall sensor 16, to thereby generate a control signal for the power/rotation speed. The control signals are transmitted via electrically conductive pathways of the circuit board 4 to the transmitter 2 for transmission to a receiver 26 of the power controllers for subsequent control of the motor 24. FIG. 4 shows by way of a block diagram the operation and relationship between the components of the control device 30.

The transmitter 2 is so positioned and aligned upon the load-carrying member 21 as to face the receiver 26, with the angle of radiation selected to ensure that infrared light reaches the receiver 26. For safety reasons, the transmitter 2 sends the control signals encoded with an address information for the receiver 26 being addressed.

For ergonomic reasons, both keys 5, 6 are actuated on the handle at the load-carrying member 21 from the outside by a swivel key via a switching rocker (not shown), arranged at the housing 23 and formed as a two-armed lever.

While the invention has been illustrated and described as embodied in a device for controlling a motor-driven hoist, it is not intended to be limited to the details shown since various modifications and structural changes may be made without departing in any way from the spirit of the present invention.

What is claimed as new and desired to be protected by Letters Patent is set forth in the appended claims:

1. A device for controlling a motor-driven hoist;

a housing;

a power source, secured to the housing, for providing electric energy;

a control unit supplied with electric energy from the power source and secured to the housing, said control unit having control elements operable from outside the housing between an inactive ready position and an active position for delivering control signals;

a transmitter supplied with electric energy from the power source and receiving the control signals from the control unit for wireless transmission of the control signals to a receiver operatively connected to a power controller of a drive of a motor-driven hoist; and an activation switch so operatively connected to the power source that actuation of any one of the control elements establishes a supply of electric energy from the power source, whereas the supply of electric energy from the power source is cut, when all the control elements occupy their ready position.

2. The device of claim 1, wherein each of the control elements is constructed to activate the activation switch during the course of its actuation.

3. The device of claim 1, wherein all the control elements are operatively connected to the activation switch for switching the activation switch ON and OFF.

4. The device of claim 3, and further comprising a common mechanical connecting member placed between the control elements and the activation switch and actuated by any one of the control elements for operating the activation switch.

5. The device of claim 4, wherein the connecting member is so coupled to the control elements as to be displaceable by each of the control elements.

6. The device of claim 1, and further comprising a plurality of said activation switch, each of the activation switches being operatively connected to a corresponding one of the control elements, whereby the activation switches and the control elements are placed into one-to-one correspondence, wherein each of the control elements is configured as a push-button key so biased by a spring as to seek the ready position.

7. The device of claim 1, and further comprising an actuating mechanism for operating two of the control elements, said actuating mechanism including a rocker in the form of a lever having two lever arms, with one lever arm intended for operation of one of the control elements, and with the other lever arm intended for operation of the other one of the control elements, said actuator further including a pair of push buttons operatively connected to the rocker for actuating one or the other one of the control elements.

8. The device of claim 1, wherein the housing is formed as a handle mounted to a load-carrying member of the hoist.

9. The device of claim 1, wherein the control signals being sent out by the transmitter are encoded before transmission by the transmitter.

10. The device of claim 1, wherein the transmitter sends the control signal by means of infrared light, with the transmitter and the receiver confronting one another.

11. The device of claim 1, wherein the transmitter sends the control signal by means of infrared light at an angle of radiation sufficient to ensure a reception by the receiver.

12. The device of claim 1, wherein the control signals contain an address information for the receiver being addressed.

13. A hoist;

a lifting device having a motor for raising and lowering a load;

a power source; and a control unit operatively connected to the power source and including:

a plurality of keys, which are actuatable by an operator, a transmitter rendered operative in response to an actuation of at least one of the keys for wireless transmission of a control signal, a receiver, operatively connected to the motor, for receiving the control signal, and an activation switch automatically cutting the power supply from the power source absent actuation of at least one of the keys.

14. The hoist of claim 13, wherein the control unit includes a connecting member placed between the keys and actuated by each one of the keys the activation switch for operating the activation switch.

15. The hoist of claim 14, wherein the connecting member is so coupled to the keys as to be displaceable by each of the control elements.

16. The hoist of claim 13, wherein the transmitter sends the control signal by means of infrared light, with the transmitter and the receiver confronting one another.

17. The hoist of claim 13, wherein the transmitter sends the control signal by means of infrared light at an angle of radiation sufficient to ensure a reception by the receiver.

18. The hoist of claim 13, and further comprising an encoder for encoding the control signals before transmission by the transmitter.

19. The device of claim 13, wherein the control signal contains an address information for the receiver being addressed.

* * * * *